US011259638B2

(12) United States Patent
Chen et al.

(10) Patent No.: US 11,259,638 B2
(45) Date of Patent: Mar. 1, 2022

(54) CHAIR WITH FOOTREST MECHANISM

(71) Applicant: Libin Chen, Changzhou (CN)

(72) Inventors: Libin Chen, Changzhou (CN); Qinglei Kong, Changzhou (CN)

(73) Assignee: Libin Chen, Changzhou (CN)

( * ) Notice: Subject to any disclaimer, the term of this patent is extended or adjusted under 35 U.S.C. 154(b) by 0 days.

(21) Appl. No.: 17/146,503

(22) Filed: Jan. 12, 2021

(65) Prior Publication Data

US 2021/0212471 A1 Jul. 15, 2021

(30) Foreign Application Priority Data

Jan. 14, 2020 (CN) ..... 202020071652.5

(51) Int. Cl.
*A47C 7/52* (2006.01)
*A47C 4/28* (2006.01)

(52) U.S. Cl.
CPC . *A47C 7/52* (2013.01); *A47C 4/28* (2013.01)

(58) Field of Classification Search
CPC ..... A47C 7/50; A47C 7/52
USPC ..... 297/30
See application file for complete search history.

(56) References Cited

U.S. PATENT DOCUMENTS 6,209,951 B1 * 4/2001 Han ..... A47C 4/286 297/188.14
6,264,271 B1 * 7/2001 Munn ..... A47C 4/286 297/372
6,843,527 B2 * 1/2005 Nelson ..... A47C 4/40 297/129
8,794,698 B2 * 8/2014 Halsey ..... A63F 13/803 297/153
10,455,942 B2 * 10/2019 Chen ..... A47C 4/286

* cited by examiner

*Primary Examiner* — Sarah B McPartlin
(74) *Attorney, Agent, or Firm* — Bayramoglu Law Offices LLC

(57) ABSTRACT

A chair with a footrest mechanism includes two upright rods, a seat cushion arranged between the two upright rods, and a footrest mechanism. A hanging part is arranged on each of both sides of the seat cushion, and both ends of the hanging part are fixedly connected to the seat cushion. The middle part of the hanging part is fixed to the upper end of the upright rod. The footrest mechanism includes a footrest part, a connecting rod and a pull belt. A first end portion of the connecting rod is fixedly connected to the footrest part, and a second end portion of the connecting rod is fixedly connected to the seat cushion. A first end portion of the pull belt is fixedly connected to the footrest part, and a second end portion of the pull belt is connected to the hanging part.

11 Claims, 11 Drawing Sheets

CHAIR WITH FOOTREST MECHANISM

CROSS REFERENCE TO THE RELATED APPLICATIONS

This application is based upon and claims priority to Chinese Patent Application No. 202020071652.5, filed on Jan. 14, 2020, the entire contents of which are incorporated herein by reference.

TECHNICAL FIELD

The present invention relates to furniture pieces, and more particularly, to a chair with a footrest mechanism.

BACKGROUND

Chairs in the prior art, especially the folding chairs, typically do not provide users with a footrest mechanism that is convenient to rest their feet while sitting. As a result, users cannot comfortably rest their feet when seated.

Therefore, it is highly desirable to provide an improved chair with a footrest mechanism.

SUMMARY

In order to solve the problem that chairs in the prior art do not provide the user with a footrest mechanism that is convenient to rest their feet when sitting, the present invention provides a chair with a footrest mechanism to solve the above-mentioned problem.

In order to solve the above-mentioned technical problems, the present invention adopts the following technical solution. A chair with a footrest mechanism includes:

two upright rods, a seat cushion arranged between the two upright rods, and a footrest mechanism.

A hanging part is arranged on each of both sides of the seat cushion, and each hanging part corresponds to one upright rod. Both ends of the hanging part are fixedly connected to the seat cushion. The middle part of the hanging part is fixed to the upper end of the upright rod.

The footrest mechanism includes a footrest part, a connecting rod and a pull belt.

A first end portion of the connecting rod is fixedly connected to the footrest part, and a second end portion of the connecting rod is fixedly connected to the seat cushion.

A first end portion of the pull belt is fixedly connected to the footrest part, and a second end portion of the pull belt or a portion of the pull belt approaching the second end portion of the pull belt is fixedly connected to the hanging part.

Preferably, the second end portion of the pull belt is detachably fixed to the hanging part; and the second end portion of the connecting rod is detachably fixed to the seat cushion.

Preferably, the chair with the footrest mechanism further includes a storage container and a strap. The storage container and the strap are both fixedly connected to the upright rod, and the strap is located above the storage container.

Preferably, the length of the pull belt is adjustable.

Preferably, the pull belt includes a first segment and a second segment.

A first end portion of the first segment is the first end portion of the pull belt, and a first end portion of the second segment is the second end portion of the pull belt.

A buckle is fixed to a second end portion of the second segment, and a portion of the second segment approaching a second end portion of the first segment passes through the buckle.

Preferably, the length of the pull belt is adjustable.

The second end portion of the connecting rod is detachably fixed to the seat cushion.

The connecting rod includes a first rod portion and a second rod portion. A first end portion of the first rod portion is the first end portion of the connecting rod, and a first end portion of the second rod portion is the second end portion of the connecting rod.

A second end portion of the first rod portion is hinged to a second end portion of the second rod portion.

Preferably, the chair with the footrest mechanism further includes a storage bag, and the storage bag is fixedly connected to the seat cushion.

Preferably, a first sleeving member is sleeved on the second end portion of the first rod portion, a second sleeving member is sleeved on the second end portion of the second rod portion, and the first sleeving member is hinged to the second sleeving member.

The first sleeving member is provided with a first abutting block, and the second sleeving member is provided with a second abutting block. When the first rod portion and the second rod portion are unfolded to a preset angle, the first abutting block and the second abutting block abut against each other.

Preferably, two second sleeves are fixed at the bottom of the seat cushion, and each second sleeve corresponds to one connecting rod. The second end portion of the connecting rod is inserted in the second sleeve.

Preferably, the chair with the footrest mechanism further includes a buckle. The buckle is fixedly connected to the hanging part.

The portion of the pull belt approaching the second end portion of the pull belt passes through the buckle.

The present invention has the following advantages. When the chair with the footrest mechanism is in use, under the traction of the pull belt and the support of the connecting rod, the footrest part is located below the front of the seat cushion, so that the user can relax by resting the feet on the seat cushion when seated on the seat cushion.

BRIEF DESCRIPTION OF THE DRAWINGS

The present invention is further explained in combination with the drawings and embodiments below.

Figure 1:
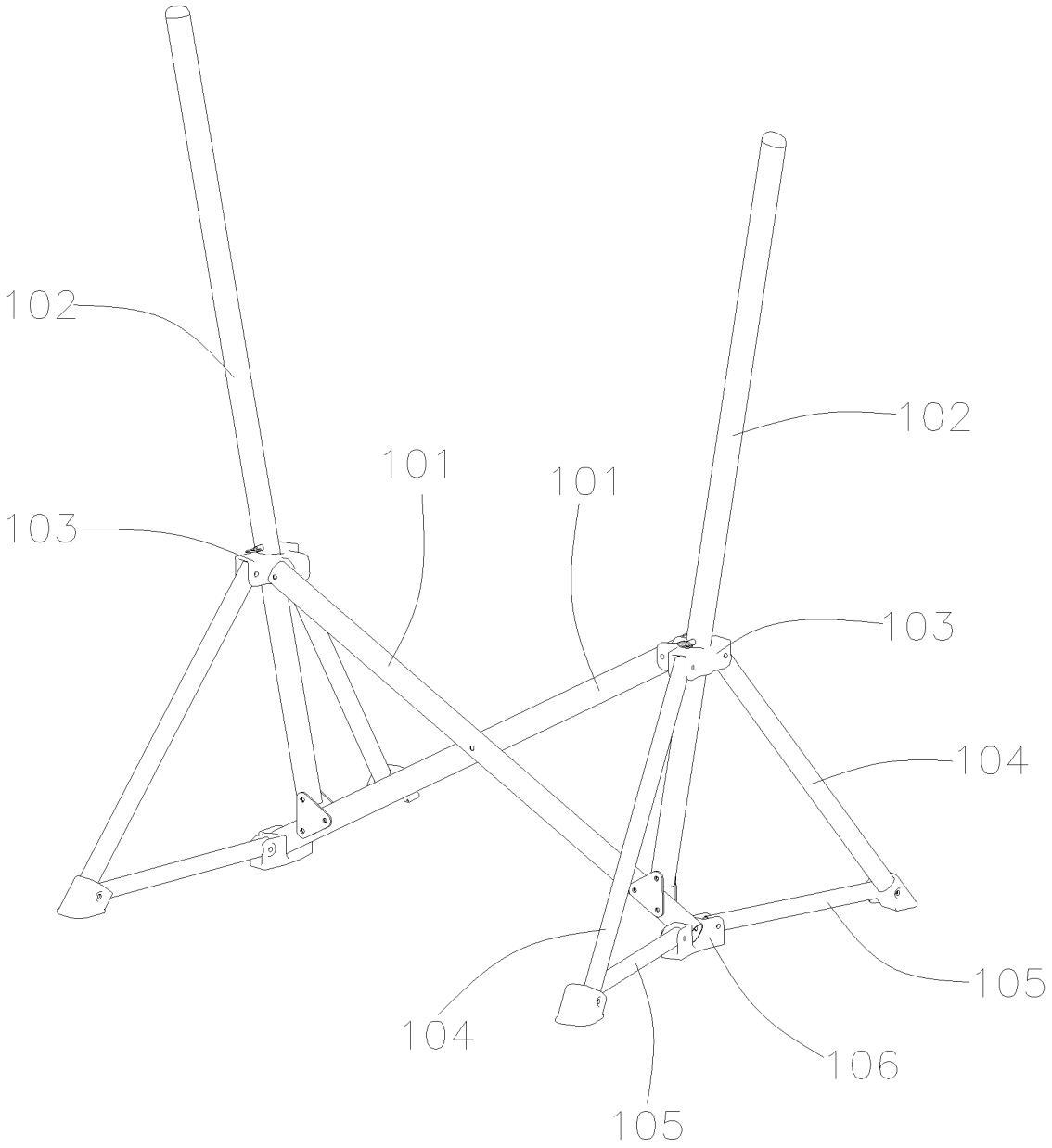
FIG. 1 is a schematic diagram of part of the structure of a chair with a footrest mechanism according to Embodiment 1 of the present invention.

In the figures: 1—chair frame, 101—linkage rod, 102—upright rod, 103—sliding sleeve, 104—inclined supporting rod, 105—underframe rod, 106—connector, 201—seat cushion, 2011—second sleeve, 202—hanging part, 2021—first sleeve, 203—armrest rod, 204—backrest part, 301—footrest part, 302—connecting rod, 3021—first rod portion, 3022—first sleeving member, 3023—first abutting block, 3024—second rod portion, 3025—second sleeving member, 3026—second abutting block, 303—pull belt, 3031—first segment, 3032—second segment, 304—buckle, 305—secondary clamping member, 306—primary clamping member, 307—connecting belt, 401—storage container, 4011—strap, 402—storage bag.

DETAILED DESCRIPTION OF THE EMBODIMENTS

The present invention is described in detail below, and examples of embodiments are shown in the drawings, wherein the same or similar reference numerals throughout represent the same or similar components or the elements with the same or similar function. The following embodiments described with reference to the drawings are exemplary and only used to explain the present invention but cannot be construed as a limitation to the present invention.

In the description of the present invention, it should be understood that the orientation or positional relationship indicated by the terms "center", "longitudinal", "lateral", "length", "width", "thickness", "up/upward", "down/downward", "front", "back", "left", "right", "vertical", "horizontal", "top", "bottom", "inside", "outside", "axial", "radial" and "circumferential" is based on the orientation or positional relationship shown in the drawings, which is only for the convenience of describing the present invention and simplifying the description, rather than indicating or implying that the device or element referred to must have a specific orientation and be constructed and operated in a specific direction, and therefore cannot be construed as a limitation to the present invention.

In addition, the terms "first", "second" and the like are used only for descriptive purposes and cannot be construed as indicating or implying relative importance. In the description of the present invention, it should be stated that, unless otherwise clearly specified and defined, the term "connection/be connected to" should be understood in a broad sense, for example, it can be a fixed connection, a detachable connection, an integral connection, a mechanical connection, an electrical connection, a direct connection, or an indirect connection through an intermediate medium. For those having ordinary skill in the art, the specific meaning of the above expressions in the present invention can be understood according to specific circumstances. In addition, in the description of the present invention, unless otherwise stated, "a plurality of" means the number of two or more.

Figure 2:
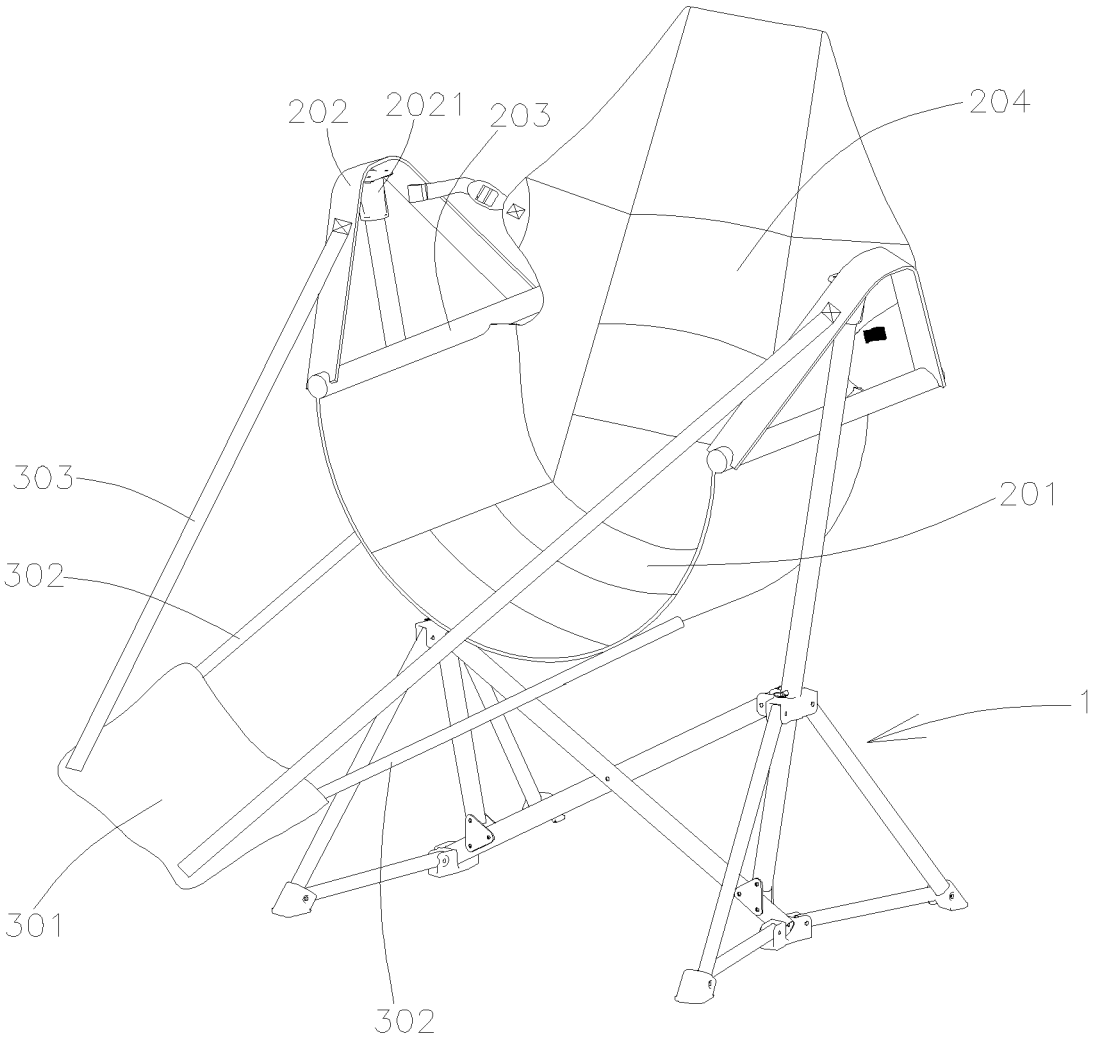
FIG. 2 is a schematic diagram of the structure of the chair with the footrest mechanism according to Embodiment 1 of the present invention.

As shown in FIGS. 1—2, according to Embodiment 1 of the present invention, a chair with a footrest mechanism includes the chair frame 1, the seat cushion 201 and a footrest mechanism.

The chair frame 1 includes a linkage mechanism and two supporting mechanisms.

The linkage mechanism includes two linkage rods 101, and the two linkage rods 101 cross each other and are hinged through a first hinge shaft.

The two supporting mechanisms are arranged on both sides of the linkage mechanism, respectively. The supporting mechanism includes the upright rod 102, the sliding sleeve 103, the connector 106, and two inclined supporting mechanisms. The sliding sleeve 103 is slidably sleeved on the upright rod 102. The upper end of one linkage rod 101 is hinged to the sliding sleeve 103 through a second hinge shaft, and the lower end of the other linkage rod 101 is hinged to the lower end of the upright rod 102 through a third hinge shaft.

The inclined supporting mechanism includes the inclined supporting rod 104 and the underframe rod 105. The upper end of the inclined supporting rod 104 is hinged to the sliding sleeve 103 through a fourth hinge shaft, and the lower end of the inclined supporting rod 104 is hinged to one end of the underframe rod 105 through a sixth hinge shaft. The other end of the underframe rod 105 is hinged to the connector 106 through a fifth hinge shaft, and the lower end of the linkage rod 101 is hinged to the connector 106 through a seventh hinge shaft.

The seat cushion 201 is arranged between two upright rods 102. In the present embodiment, the seat cushion 201 is made of flexible materials, including but not limited to cloth and net bags. The seat cushion 201 is arc-shaped and sags to form a U-shaped structure, which is convenient for users to sit down.

Two hanging parts 202 are arranged on both sides of the seat cushion 201, respectively, and each hanging part 202 corresponds to one upright rod 102. Both ends of the hanging part 202 are fixedly connected to the seat cushion 201. The middle part of the hanging part 202 is fixed to the first sleeve 2021, and the first sleeve 2021 is sleeved on the upper end of the upright rod 102. The connection form between the hanging part 202 and the upper end of the upright rod 102 is not limited to the first sleeve 2021 described above, and can also adopt other connection forms such as bolts or rivets.

The footrest mechanism includes the footrest part 301, two connecting rods 302 and two pull belts 303.

The footrest part 301 is made of flexible materials, including but not limited to cloth and net bags. The first end portion of the connecting rod 302 is fixedly connected to the bottom surface of the footrest part 301, and the second end portion of the connecting rod 302 is fixedly connected to the seat cushion 201.

The two pull belts 303 correspond to the two hanging parts 202, respectively. The first end portion of the pull belt 303 is fixedly connected to the top surface of the footrest part 301, and the second end portion of the pull belt 303 or the portion of the pull belt 303 approaching the second end portion of the pull belt 303 is fixedly connected to the corresponding hanging part 202.

In the present embodiment, under the traction of the pull belts 303 and the support of the connecting rods 302, the footrest part 301 is located at the front of the seat cushion 201, so that the user can relax by resting the feet on the footrest part 301 when seated on the seat cushion 201.

In the present embodiment, the chair with the footrest mechanism further includes two armrest rods 203, and the two armrest rods 203 are arranged on both sides of the seat cushion 201, respectively. Each armrest rod 203 corresponds to one hanging part 202, and both ends of the hanging part 202 are fixedly connected to both ends of the armrest rod 203, respectively. The chair with the footrest mechanism further includes the backrest part 204 for resting the back, and the backrest part 204 is fixedly connected to the seat cushion 201.

When the user sits on the seat cushion 201, it is convenient for the user to rest an arm on the armrest rod 203 and recline on the backrest part 204.

Figure 3:
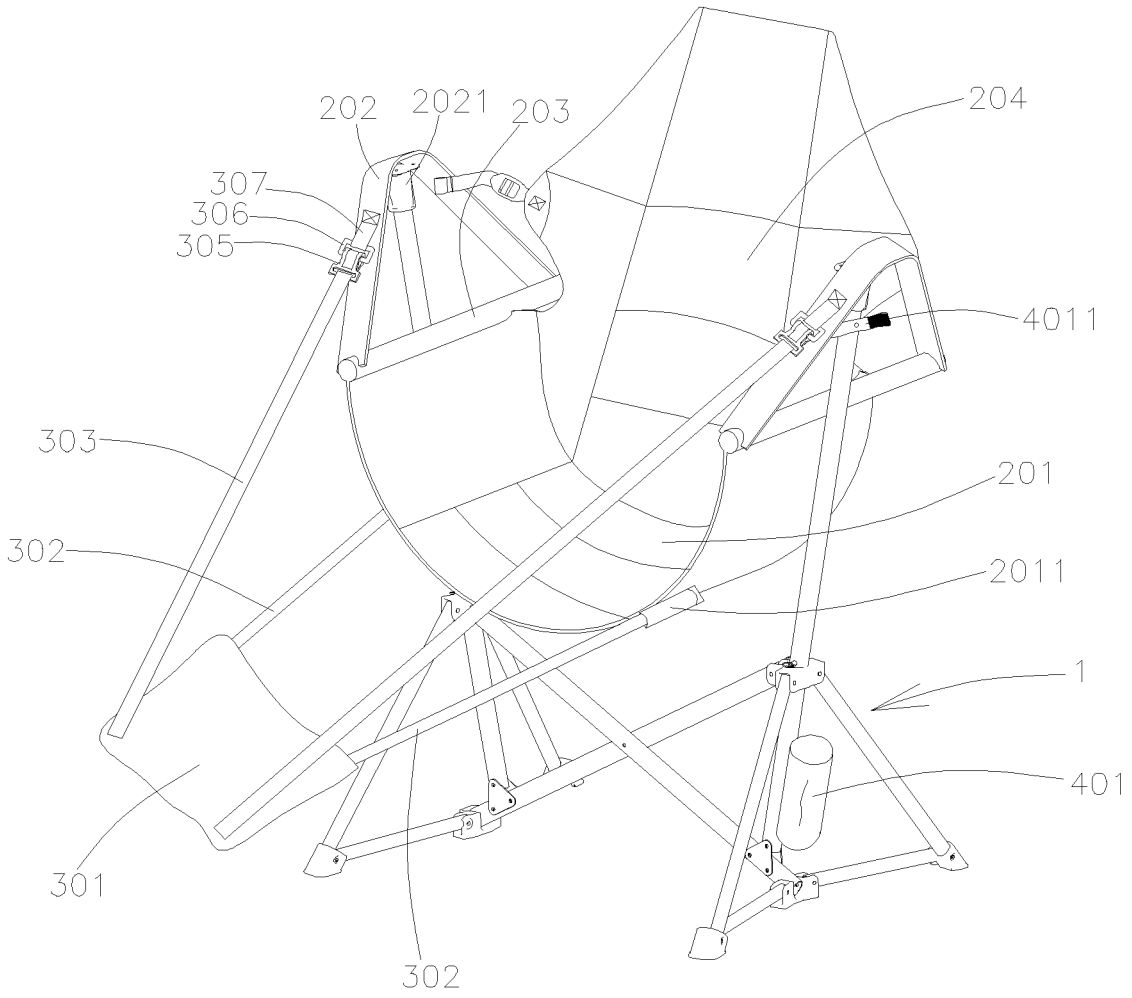
FIG. 3 is a schematic diagram of the structure of the chair with the footrest mechanism according to Embodiment 2 of the present invention.

As shown in FIG. 3, according to Embodiment 2, on the basis of Embodiment 1, the second end portion of the pull belt 303 is detachably fixed to the hanging part 202 in a specific manner as follows. The secondary clamping member 305 is fixedly arranged at the second end portion of the pull belt 303, and the secondary clamping member 305 is provided with a hook. The primary clamping member 306 is fixed to the hanging part 202 directly or through the connecting belt 307, and the primary clamping member 306 is provided with a buckle hole adapted to be hooked by the hook.

According to other embodiments, the second end portion of the pull belt 303 and the hanging part 202 are detachably fixed in a specific manner as follows. The second end portion of the pull belt 303 and the hanging part 202 are fixed by a plastic buckle, that is, the male buckle of the plastic buckle is fixed to the second end portion of the pull belt 303, and the female buckle of the plastic buckle is fixed to the hanging part 202 directly or through the connecting belt 307.

The second end portion of the connecting rod 302 is detachably fixed to the seat cushion 201 in a specific manner as follows. Two second sleeves 2011 are fixed at the bottom of the seat cushion 201, and each second sleeve 2011 corresponds to one connecting rod 302. The second end portion of the connecting rod 302 is inserted in the second sleeve 2011.

The chair with the footrest mechanism further includes the storage container 401 and the strap 4011. The storage container 401 and the strap 4011 are both fixedly connected to the upright rod 102, and the strap 4011 is located above the storage container 401. The middle portion of the strap 4011 is fixedly connected to the upright rod 102, and the two ends of the strap 4011 are separately provided with hook and loop fasteners that can be affixed to each other.

In the present embodiment, when the chair with the footrest mechanism is not in use, the pull belt 303 is detached from the hanging part 202, and the second end portion of the connecting rod 302 is pulled out of the sleeve. The connecting rod 302, the footrest part 301 and the pull belt 303, after being folded, may then be inserted into the storage container 401 and fixedly tied by using the strap 4011 for compartmentalized storage to save space.

Figure 4:
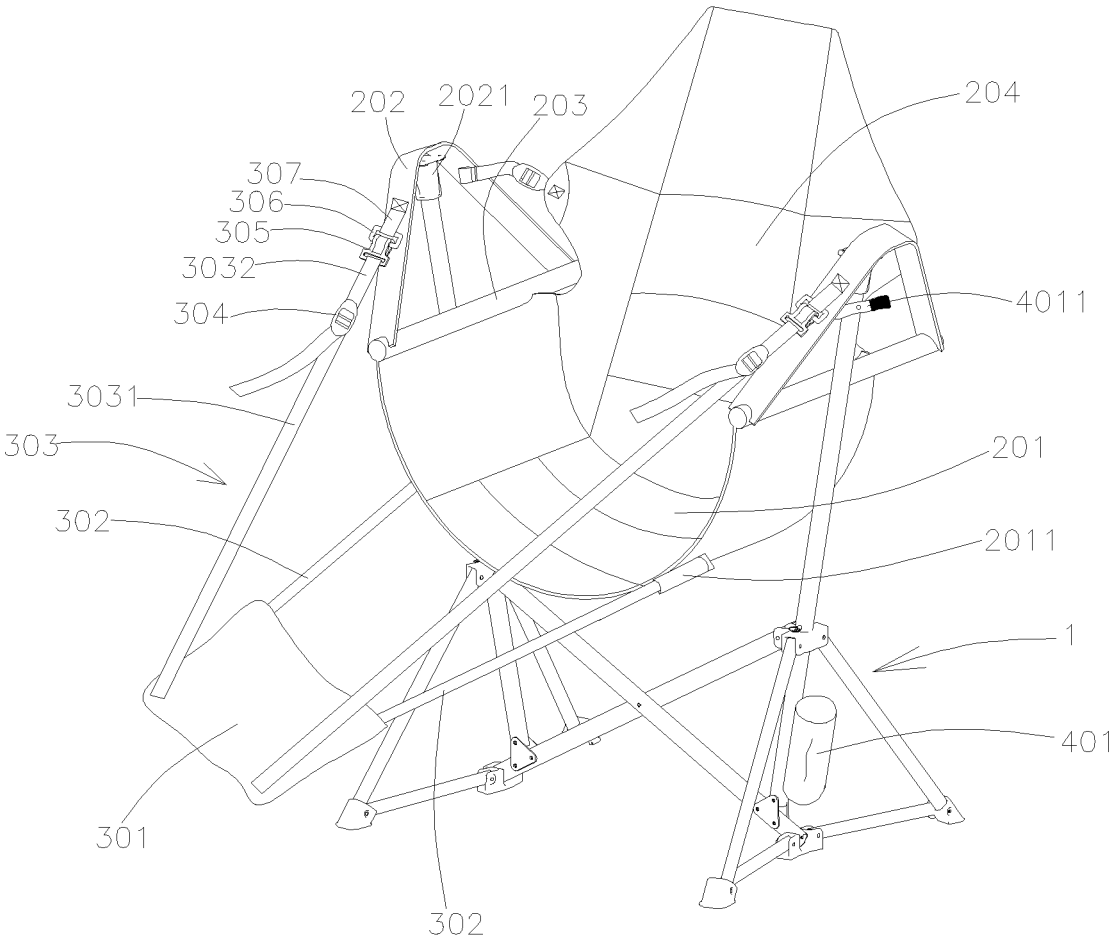
FIG. 4 is a schematic diagram of the structure of the chair with the footrest mechanism according to Embodiment 3 of the present invention.
Figure 5:
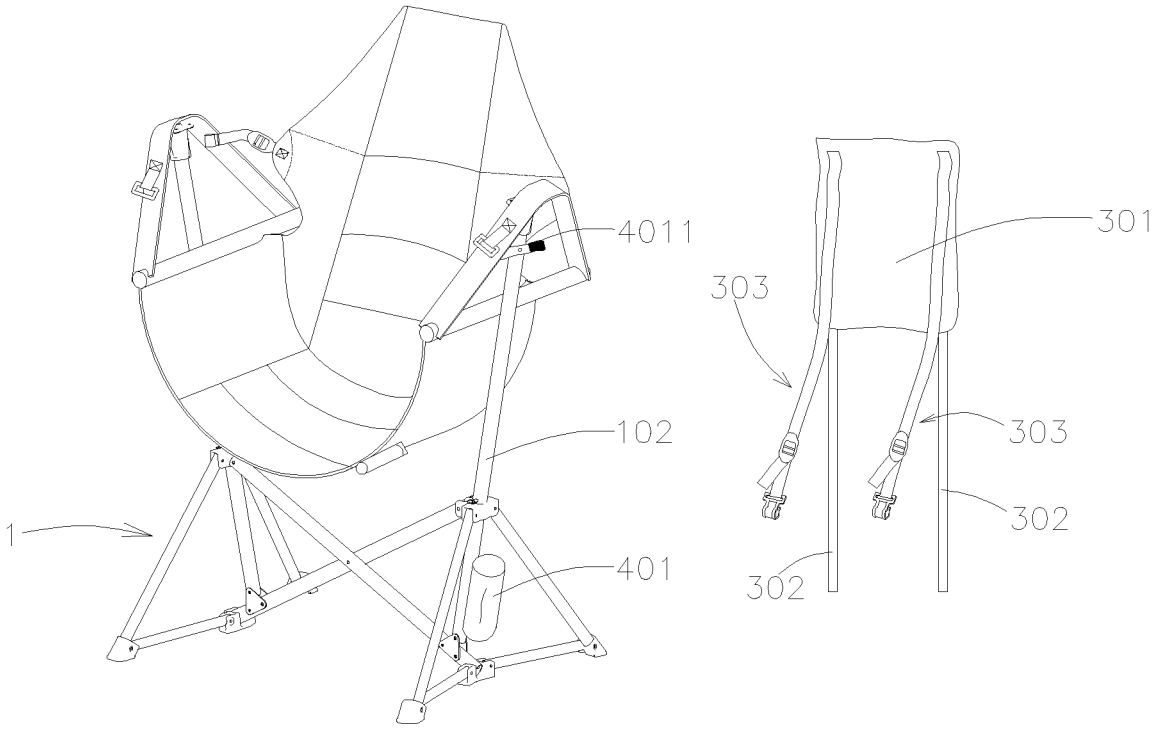
FIG. 5 is a schematic diagram of another state of the structure of the chair with the footrest mechanism in FIG. 4.
Figure 6:
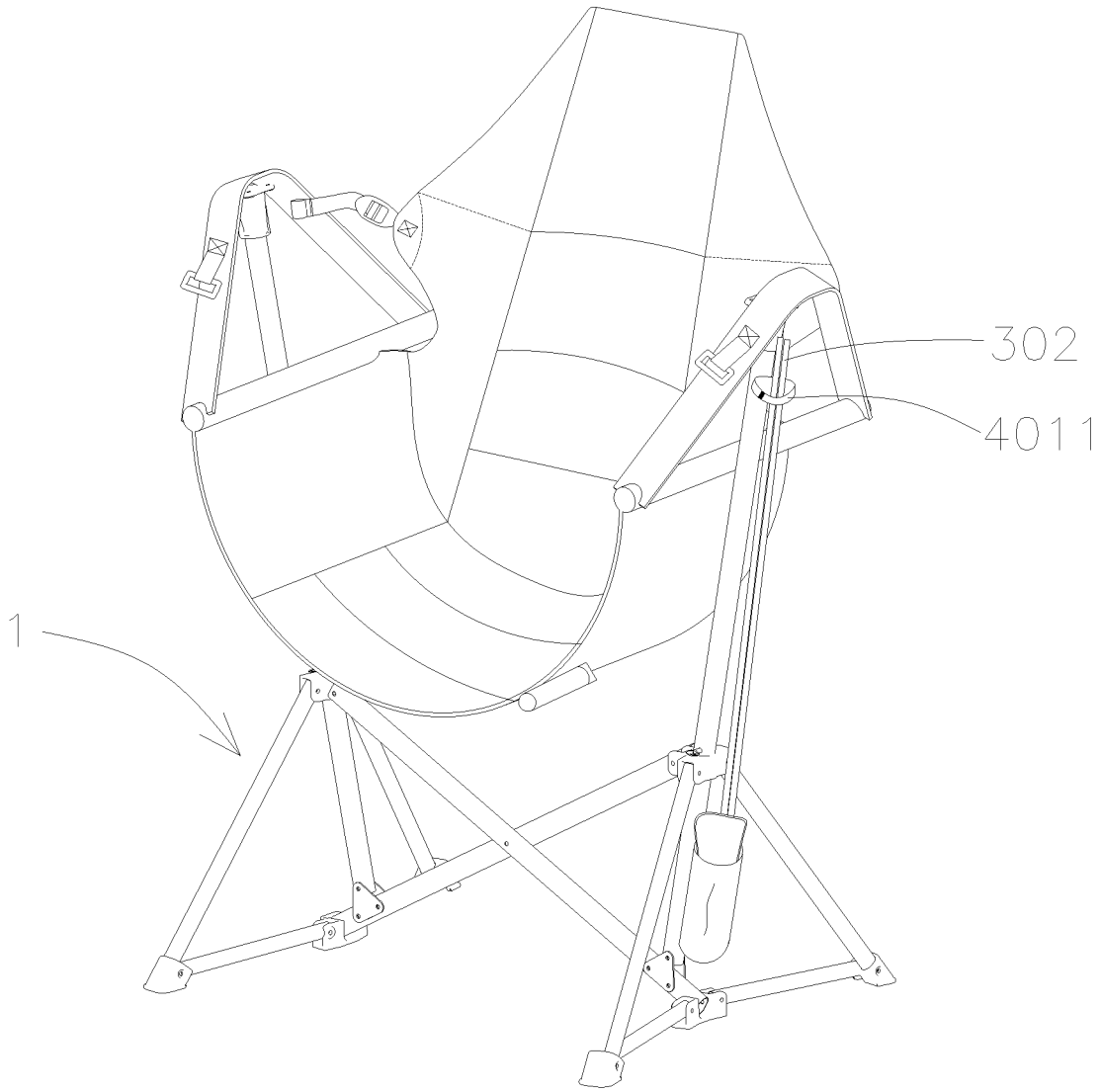
FIG. 6 is a schematic diagram of yet another state of the structure of the chair with the footrest mechanism in FIG. 4.
Figure 7:
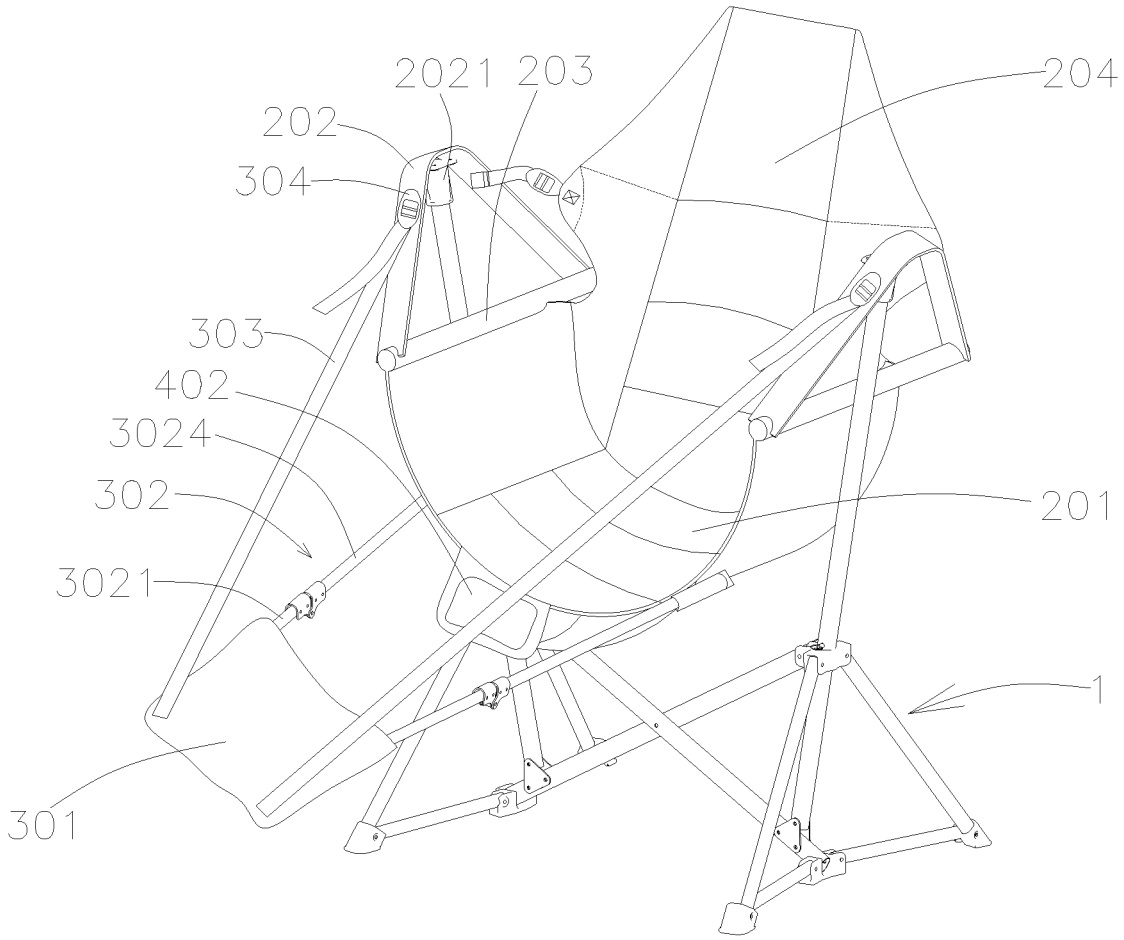
FIG. 7 is a schematic diagram of the structure of the chair with the footrest mechanism according to Embodiment 4 of the present invention.
Figure 8:
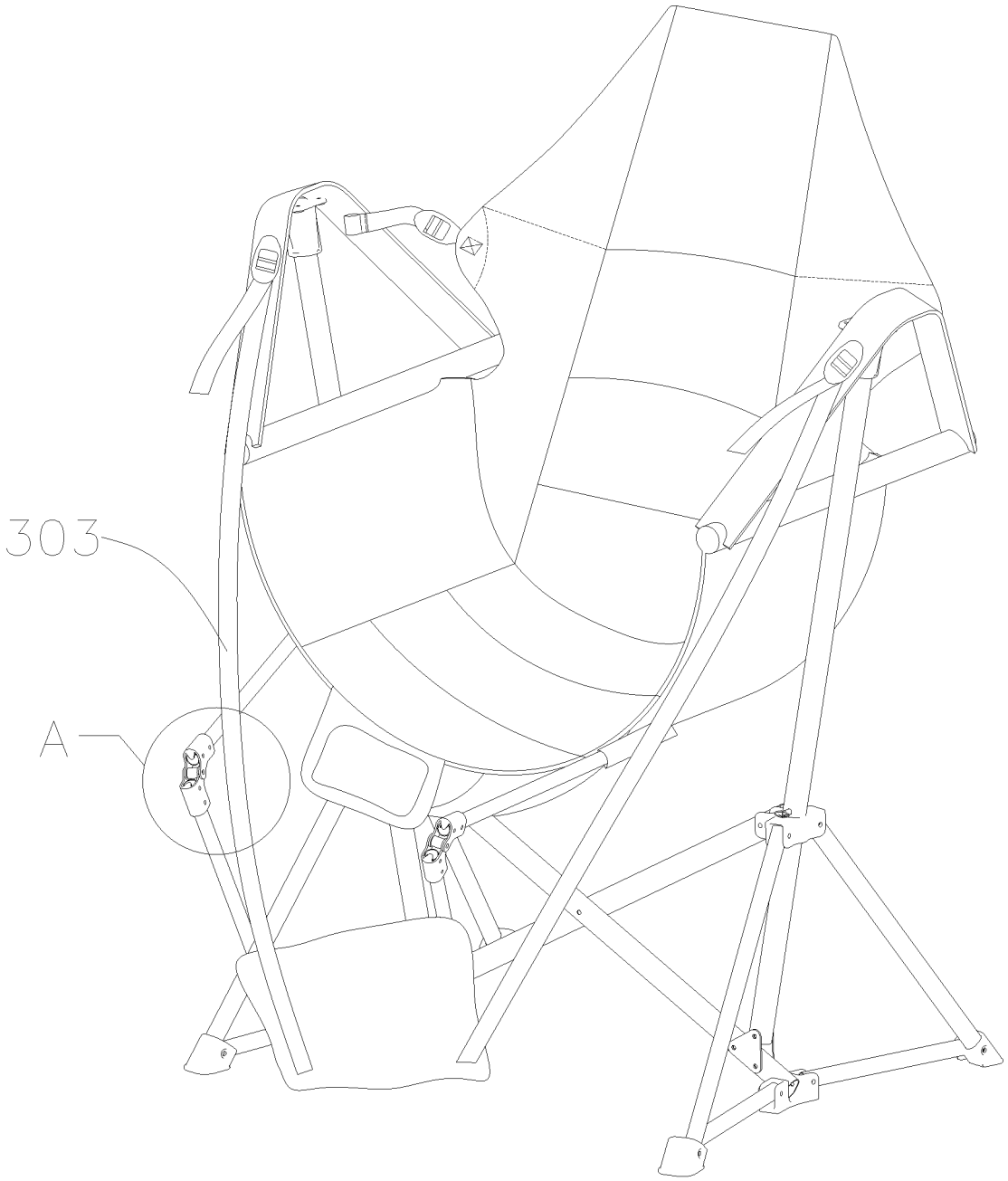
FIG. 8 is a schematic diagram of another state of the structure of the chair with the footrest mechanism in FIG. 7.
Figure 9:
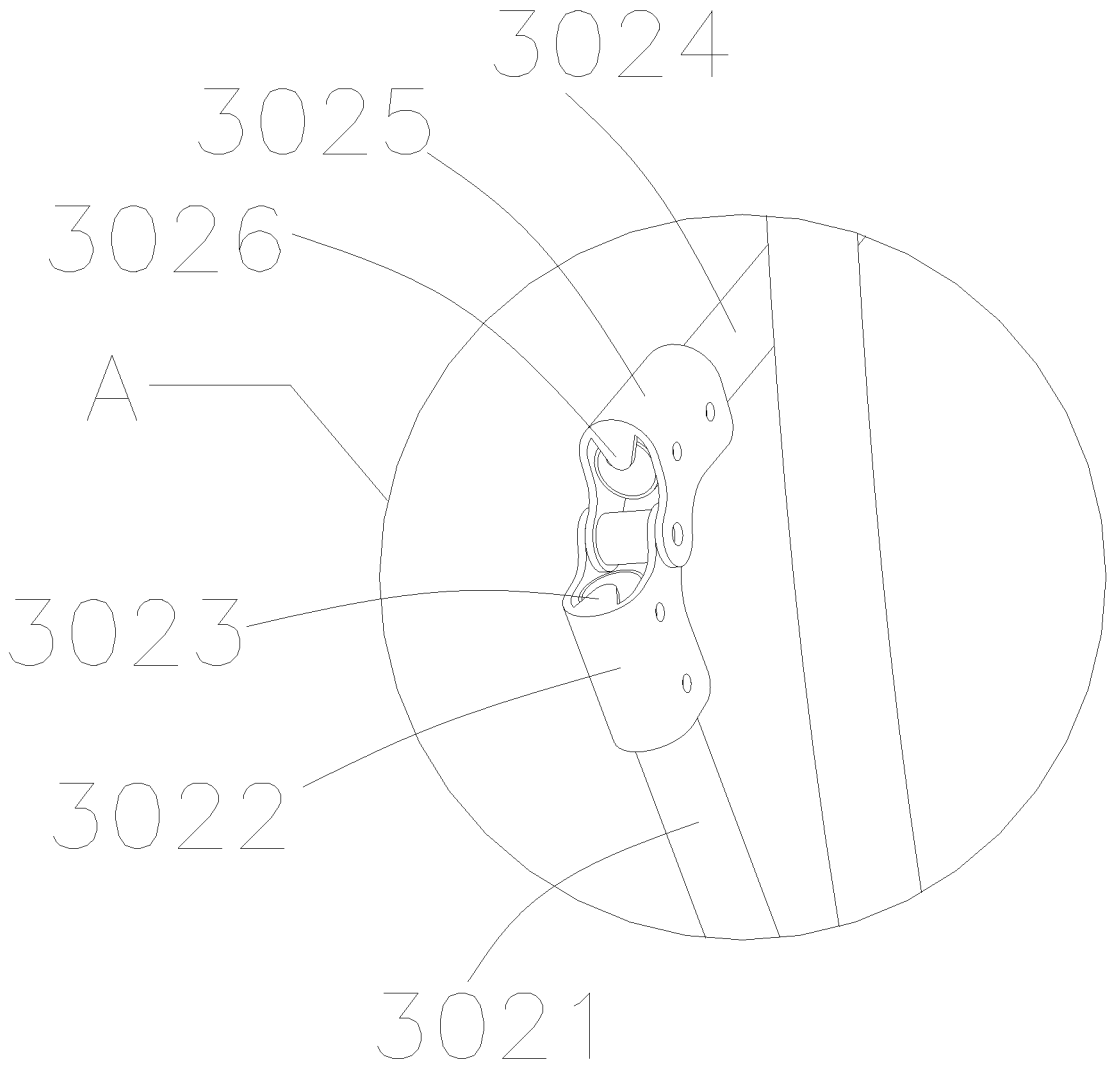
FIG. 9 is an enlarged view of the portion A circled in FIG. 8.
Figure 10:
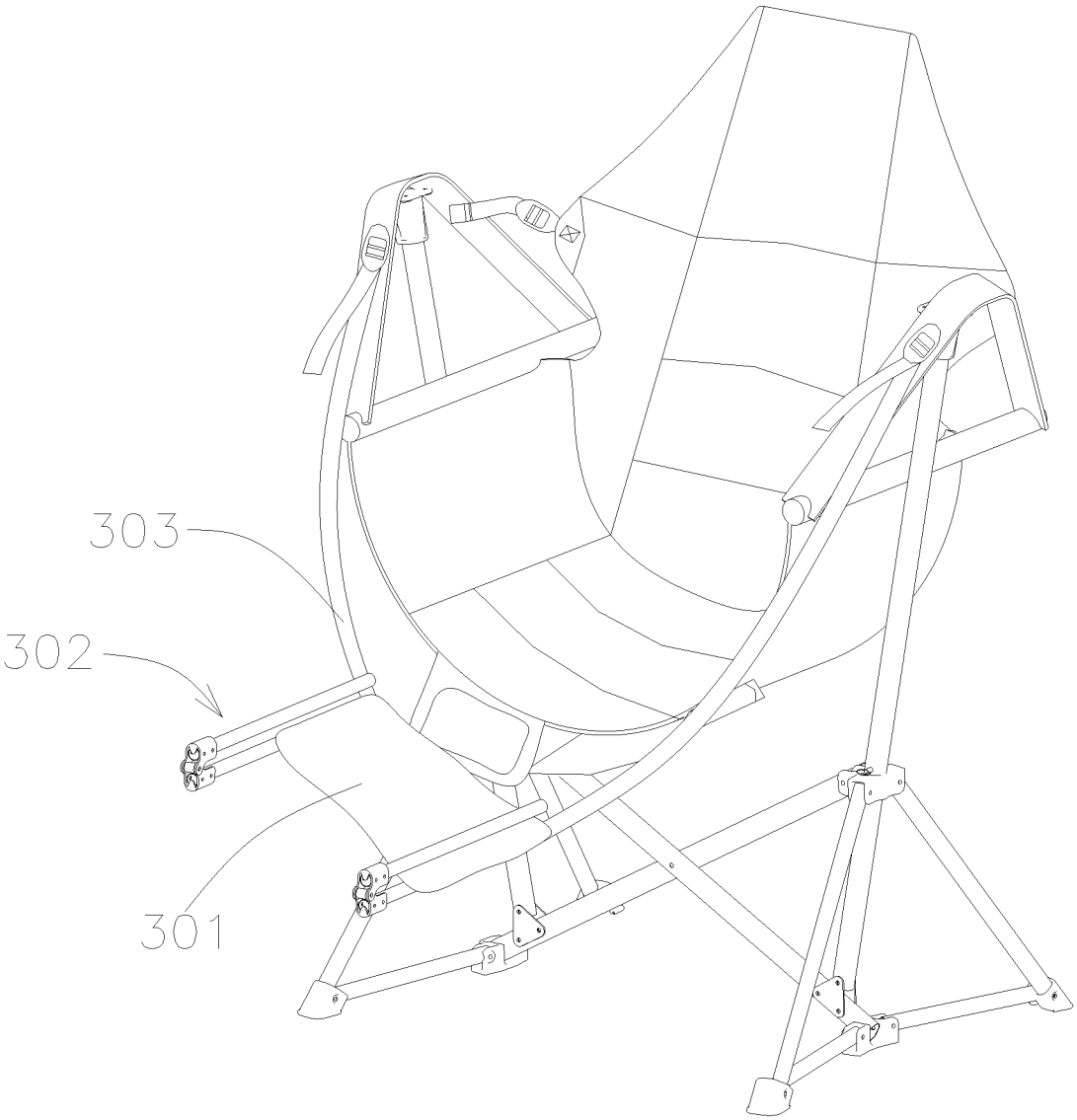
FIG. 10 is a schematic diagram of yet another state of the structure of the chair with the footrest mechanism in FIG. 7.
Figure 11:
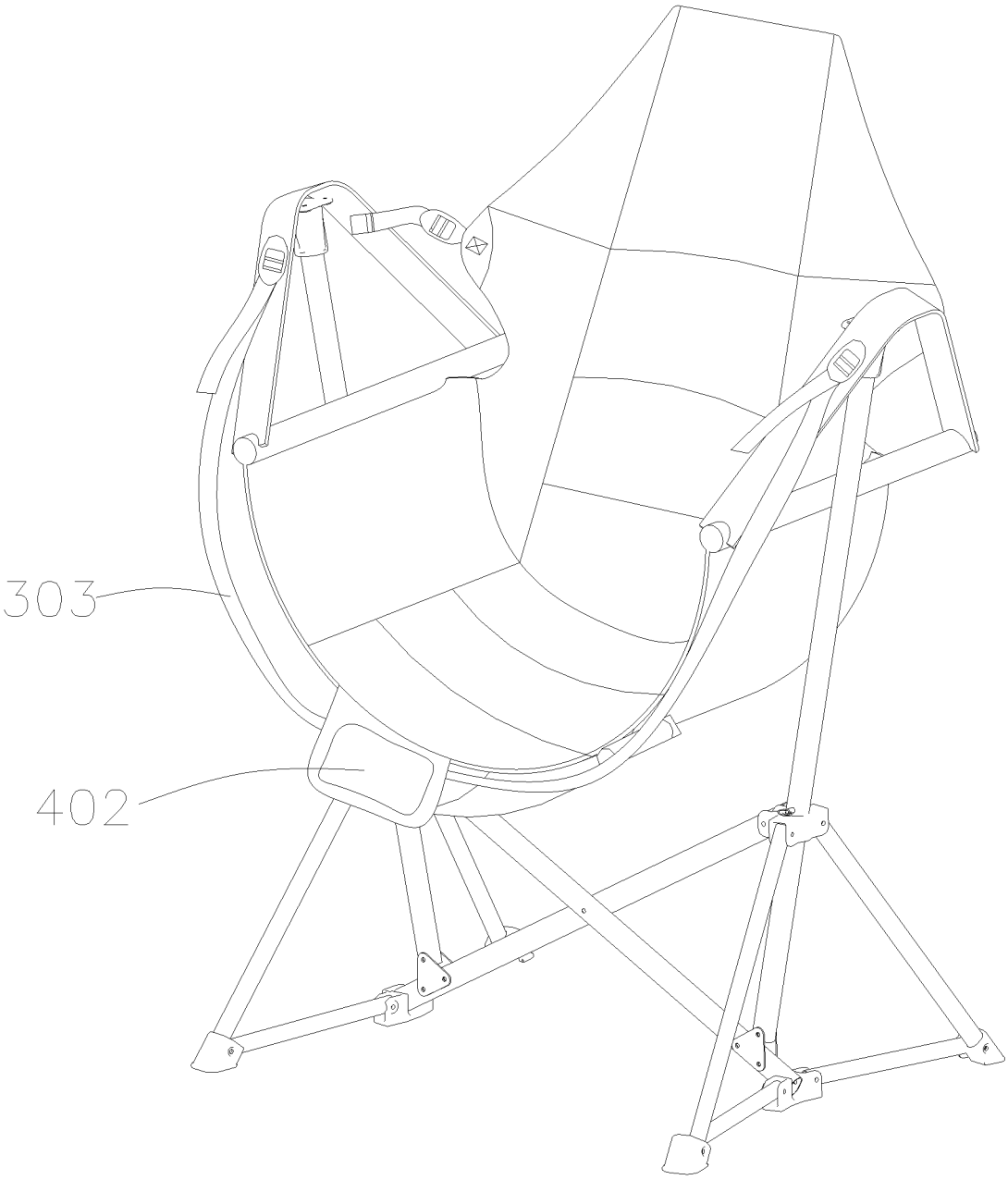
FIG. 11 is a schematic diagram of still another state of the structure of the chair with the footrest mechanism in FIG. 7.

Referring to FIGS. 4-6, according to Embodiment 3, on the basis of Embodiment 2, the length of the pull belt 303 is adjustable in a specific manner as follows. The pull belt 303 includes the first segment 3031 and the second segment 3032. The first end portion of the first segment 3031 is the first end portion of the pull belt 303, and the first end portion of the second segment 3032 is the second end portion of the pull belt 303. The buckle 304 is fixed to the second end portion of the second segment 3032, and the portion of the first segment 3031 approaching the second end portion of the first segment 3031 passes through the buckle 304.

In the present embodiment, by arranging the buckle 304, the pull belt 303 is capable of adjusting the length of the portion of the pull belt 303 between the buckle 304 and the footrest part 301, thereby adjusting the relative position between the footrest part 301 and the seat cushion 201, so that the user can adjust the position of the footrest part 301 to the most comfortable position for the feet to rest.

As shown in FIGS. 7-11, according to Embodiment 4, on the basis of Embodiment 1, the length of the pull belt 303 is adjustable in a specific manner as follows. The chair with the footrest mechanism further includes the buckle 304, the buckle 304 is fixedly connected to the hanging part 202 directly or through the connecting belt, and the portion of the pull belt 303 approaching the second end portion of the pull belt 303 passes through the buckle 304.

The second end portion of the connecting rod 302 is detachably fixed to the seat cushion 201 in a specific manner as follows. Two second sleeves 2011 are fixed at the bottom of the seat cushion 201, each second sleeve 2011 corresponds to one connecting rod 302, and the second end portion of the connecting rod 302 is inserted in the sleeve.

The connecting rod 302 includes the first rod portion 3021 and the second rod portion 3024. The first end portion of the first rod portion 3021 is the first end portion of the connecting rod 302, and the first end portion of the second rod portion 3024 is the second end portion of the connecting rod 302. The first sleeving member 3022 is sleeved on the second end portion of the first rod portion 3021, the second sleeving member 3025 is sleeved on the second end portion of the second rod portion 3024, and the first sleeving member 3022 is hinged to the second sleeving member 3025. The first sleeving member 3022 is provided with the first abutting block 3023, and the second sleeving member 3025 is provided with the second abutting block 3026. When the first rod portion 3021 and the second rod portion 3024 are unfolded, the first abutting block 3023 and the second abutting block 3026 abut against each other. The first rod portion 3021 and the second rod portion 3024 of the connecting rod is capable of being unfolded and folded. When the first rod portion 3021 and the second rod portion 3024 are unfolded until an angle between the first rod portion 3021 and the second rod portion 3024 reaches 180°, the first abutting block 3023 and the second abutting block 3026 abut against each other to prevent the first rod portion 3021 and the second rod portion 3024 from being further unfolded.

The chair with the footrest mechanism further includes the storage bag 402. The storage bag 402 is fixedly connected to the bottom surface or the edge of the seat cushion 201.

In the present embodiment, when the chair with the footrest mechanism is not in use, the first rod portion 3021 and the second rod portion 3024 are folded to affix to each other, and then the connecting rod 302 and the footrest part 301 are stored into the storage bag 402 to save space. Then, the second end portion of the pull belt 303 is pulled to shorten the portion of the pull belt 303 located between the buckle 304 and the footrest part 301, thereby preventing the pull belt 303 from becoming tangled.

In the description of the specification, the description of the reference terms "one embodiment", "some embodiments", "examples", "specific examples", "some examples" and the like means that the specific features, structures or materials described in combination with the embodiment or example are included in at least one embodiment or example of the present invention. In the specification, the schematic representation of the aforementioned terms does not necessarily refer to the same embodiment or example. Furthermore, the specific features, structures or materials described may be combined in an appropriate manner in any one or more embodiments or examples.

Based on the description of the foregoing ideal embodiments of the present invention and the foregoing description, those skilled in the art can make various changes and modifications without deviating from the scope of the technical ideas of the present invention. The technical scope of the present invention is not limited to the contents of the specification, and must be defined according to the scope of the claims.

What is claimed is:

1. A chair with a footrest mechanism, comprising two upright rods, a seat cushion arranged between the two upright rods, and the footrest mechanism; wherein a hanging part is arranged on each of both sides of the seat cushion, and the hanging part corresponds to each upright rod of the two upright rods; both ends of the hanging part are fixedly connected to the seat cushion; a middle part of the hanging part is fixed to an upper end of the each upright rod;

the footrest mechanism comprises a footrest part, a connecting rod and a pull belt;

a first end portion of the connecting rod is fixedly connected to the footrest part, and a second end portion of the connecting rod is fixedly connected to the seat cushion; and a first end portion of the pull belt is fixedly connected to the footrest part, and a second end portion of the pull belt or a portion of the pull belt is fixedly connected to the hanging part, wherein the portion of the pull belt approaches the second end portion of the pull belt.

2. The chair according to claim 1, wherein the second end portion of the pull belt is detachably fixed to the hanging part; and the second end portion of the connecting rod is detachably fixed to the seat cushion.

3. The chair according to claim 2, wherein two second sleeves are fixed at a bottom of the seat cushion, and each second sleeve of the two second sleeves corresponds to the connecting rod; the second end portion of the connecting rod is inserted in the each second sleeve.

4. The chair according to claim 2, further comprising a storage container and a strap; wherein the storage container and the strap are fixedly connected to the each upright rod, and the strap is located above the storage container.

5. The chair according to claim 4, wherein a length of the pull belt is adjustable.

6. The chair according to claim 5, wherein the pull belt comprises a first segment and a second segment;

a first end portion of the first segment is the first end portion of the pull belt, and a first end portion of the second segment is the second end portion of the pull belt; and a buckle is fixed to a second end portion of the second segment, and a portion of the first segment passes through the buckle; wherein the portion of the first segment approaches a second end portion of the first segment.

7. The chair according to claim 1, wherein a length of the pull belt is adjustable;

the second end portion of the connecting rod is detachably fixed to the seat cushion;

the connecting rod comprises a first rod portion and a second rod portion; a first end portion of the first rod portion is the first end portion of the connecting rod, and a first end portion of the second rod portion is the second end portion of the connecting rod; and a second end portion of the first rod portion is hinged to a second end portion of the second rod portion.

8. The chair according to claim 7, further comprising a storage bag; wherein the storage bag is fixedly connected to the seat cushion.

9. The chair according to claim 8, wherein a first sleeving member is sleeved on the second end portion of the first rod portion, a second sleeving member is sleeved on the second end portion of the second rod portion, and the first sleeving member is hinged to the second sleeving member; and the first sleeving member is provided with a first abutting block, and the second sleeving member is provided with a second abutting block; when the first rod portion and the second rod portion are unfolded to a preset angle, the first abutting block and the second abutting block abut against each other.

10. The chair according to claim 7, further comprising a buckle; wherein the buckle is fixedly connected to the hanging part; and the portion of the pull belt passes through the buckle.

11. The chair according to claim 7, wherein two second sleeves are fixed at a bottom of the seat cushion, and each second sleeve of the two second sleeves corresponds to the connecting rod; the second end portion of the connecting rod is inserted in the each second sleeve.

* * * * *